US006344137B1

(12) United States Patent
Chiang

(10) Patent No.: US 6,344,137 B1
(45) Date of Patent: Feb. 5, 2002

(54) SUPERIMPOSED DRAIN COVER

(76) Inventor: Feng-I Chiang, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/679,838

(22) Filed: Oct. 5, 2000

(51) Int. Cl.[7] ..... E02D 29/14; E03F 5/06

(52) U.S. Cl. ..... 210/164; 210/166; 404/26; 52/20

(58) Field of Search ..... 210/163, 164, 210/166; 404/25, 26; 52/19, 20

(56) References Cited

U.S. PATENT DOCUMENTS 3,215,052 A * 11/1965 Lindstad et al. ..... 404/26
3,218,943 A * 11/1965 Bowman ..... 404/26
3,237,538 A * 3/1966 McPheeters et al. ..... 404/26
3,331,295 A * 7/1967 Sorrell ..... 404/26
3,611,889 A * 10/1971 Levinson ..... 404/26
3,893,919 A * 7/1975 Flegel et al. ..... 210/166
4,188,151 A * 2/1980 Hall ..... 210/164
4,273,467 A * 6/1981 Cronk ..... 210/163
4,925,337 A * 5/1990 Spiess et al. ..... 52/20
5,044,878 A * 9/1991 Pritchard ..... 404/26
5,211,504 A * 5/1993 Trudel ..... 404/26
6,196,760 B1 * 3/2001 Sinclair ..... 404/26

* cited by examiner

*Primary Examiner*—Christopher Upton

(57) ABSTRACT

A superimposed drain cover is provided. The drain cover includes a tubular seat secured to the top of a cement drain, an outer ring engaged on the top of the seat having a tapered outer periphery and a cobweb surfaced cover covering on the top of the seat inside the outer ring. It is characterized that further has a plurality of cushion pieces and the spare superimposed rings which can be added between the seat and the cover so as to keep the cover even with a road surface without causing a traffic accident or traffic noise.

1 Claim, 7 Drawing Sheets

(5—5)

SUPERIMPOSED DRAIN COVER

BACKGROUND OF THE INVENTION

The present invention relates to drainage of road and more particularly to a superimposed drain cover which has cushions and supporting elements so that the drain cover can be higher or lower to cope with the height of the surface course of the road.

Typical drain covers (as shown in FIGS. 1 and 2) include only a tubular seat 1 embedded into the pavement and a cover 2 covered on the seat 1. This type of drain cover is difficult to adjust in height in cooperation with the road surface 4. So it may be higher or lower than the road surface which may cause a traffic accident.

FIG. 3 shows another drain cover which is a previous disclosure of mine and which includes a tubular seat 10, several layers of superimposed rings 11 under the tubular cover 12 in order to make the top of the cover 12 to be even with the road surface 13. However, once open the cover 12, especially a large one, is too heavy to be lifted by manpower. Besides, the road surface around the cover 12 has to be partially damaged and then repaired. This is a troublesome job for a worker.

SUMMARY OF THE PRESENT INVENTION

The present invention has a main object to provide a superimposed drain cover in which the relative elements have suspending facilities so that these element can be lifted by mechanical means.

Another object of the present invention is to provide a superimposed drain cover which can be opened without damaging the road surface so as to save the time and material to repair.

Accordingly, the superimposed drain cover secures to the top of a drain and has a stepped inner shoulder for superimposing a plurality of cushion pieces and layers of superimposed rings and a cobweb surfaced cover. All the heavy elements have suspending facilities so as to be lifted by mechanical means.

The present invention will become more fully understood by reference to the following detailed description thereof when read in conjunction with the attached drawings.

DETAILED DESCRIPTION OF THE PREFERRED EMBODIMENT

Figure 1:
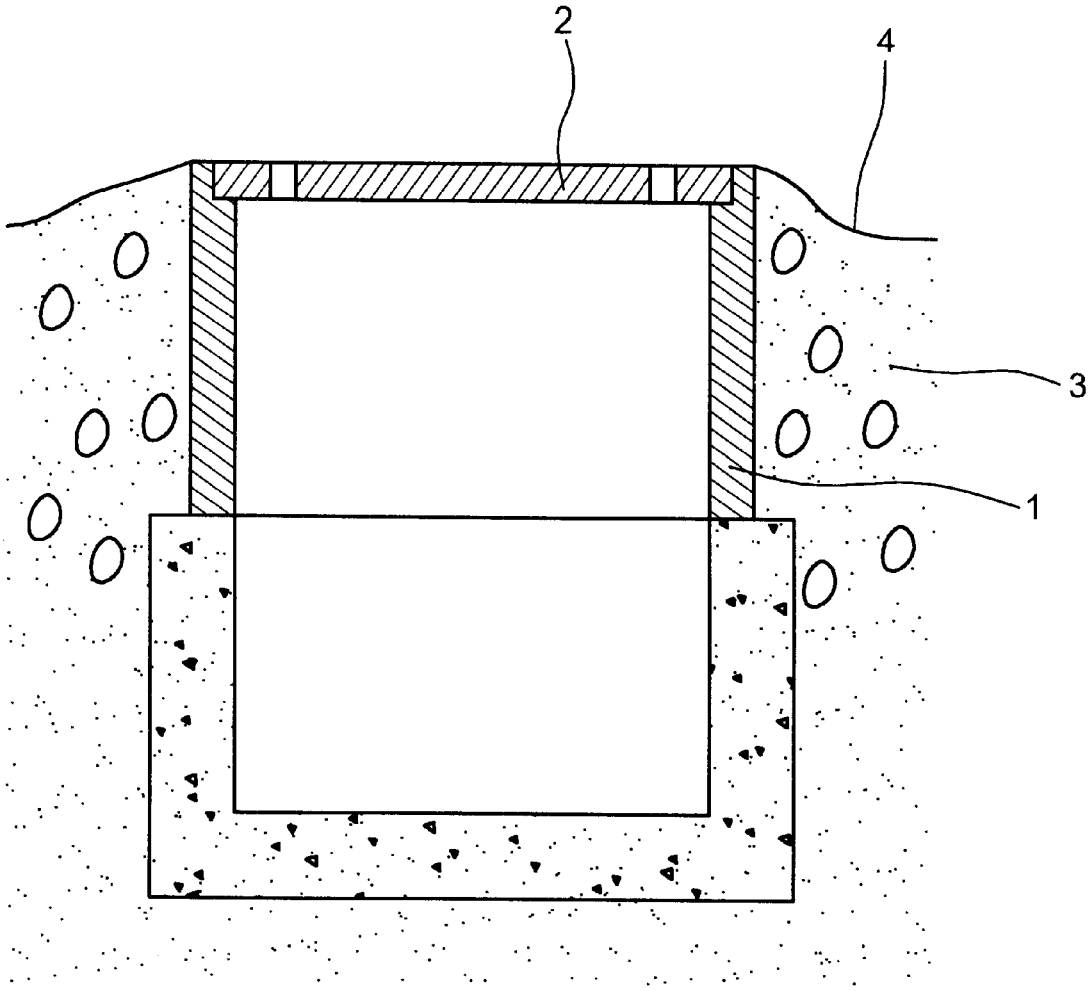
FIG. 1 Prior Art
FIG. 1 and 2 are the sectional views to show a drain cover according to a prior art.
Figure 2:
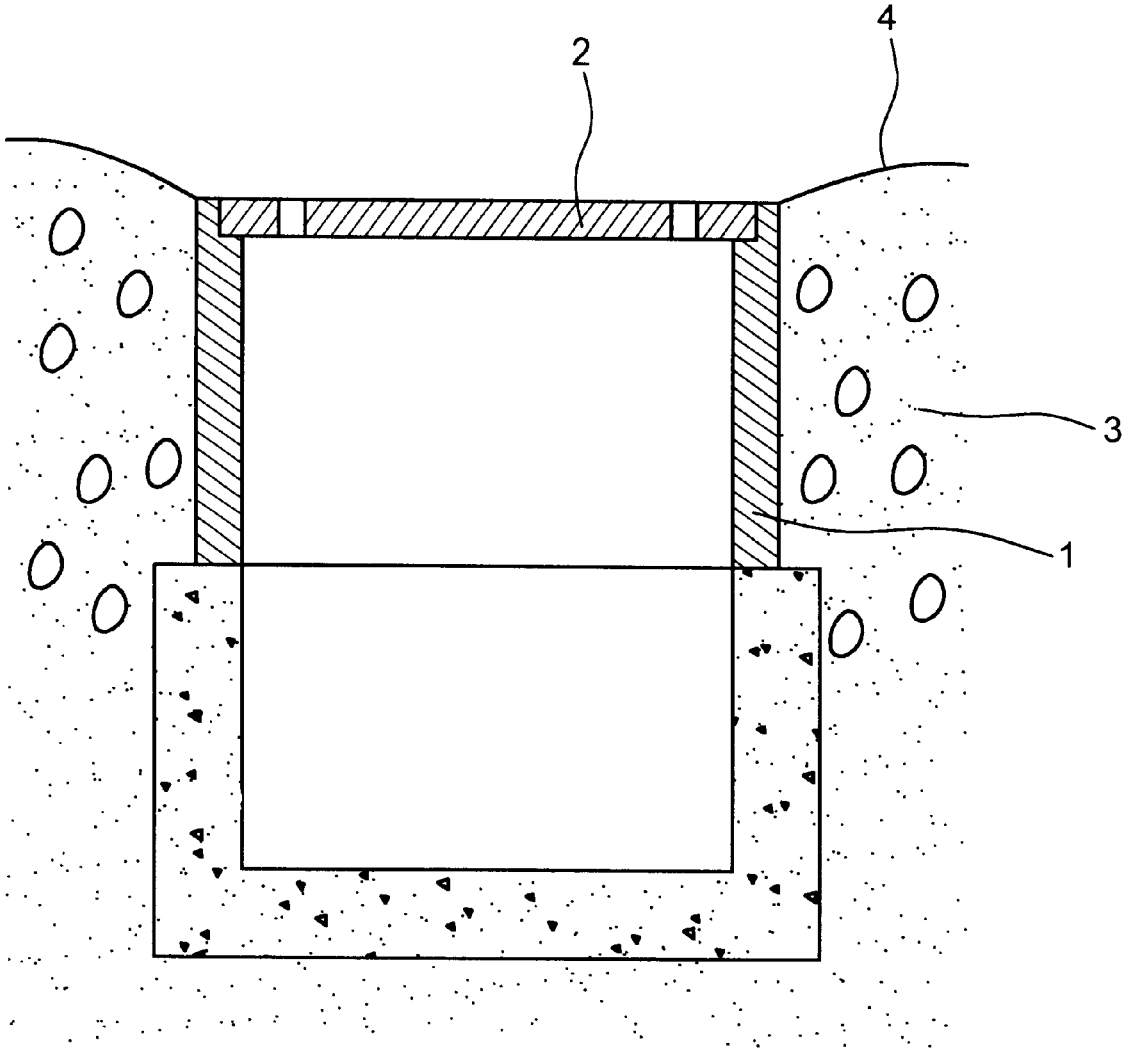
FIG.2 Prior Art
Figure 3:
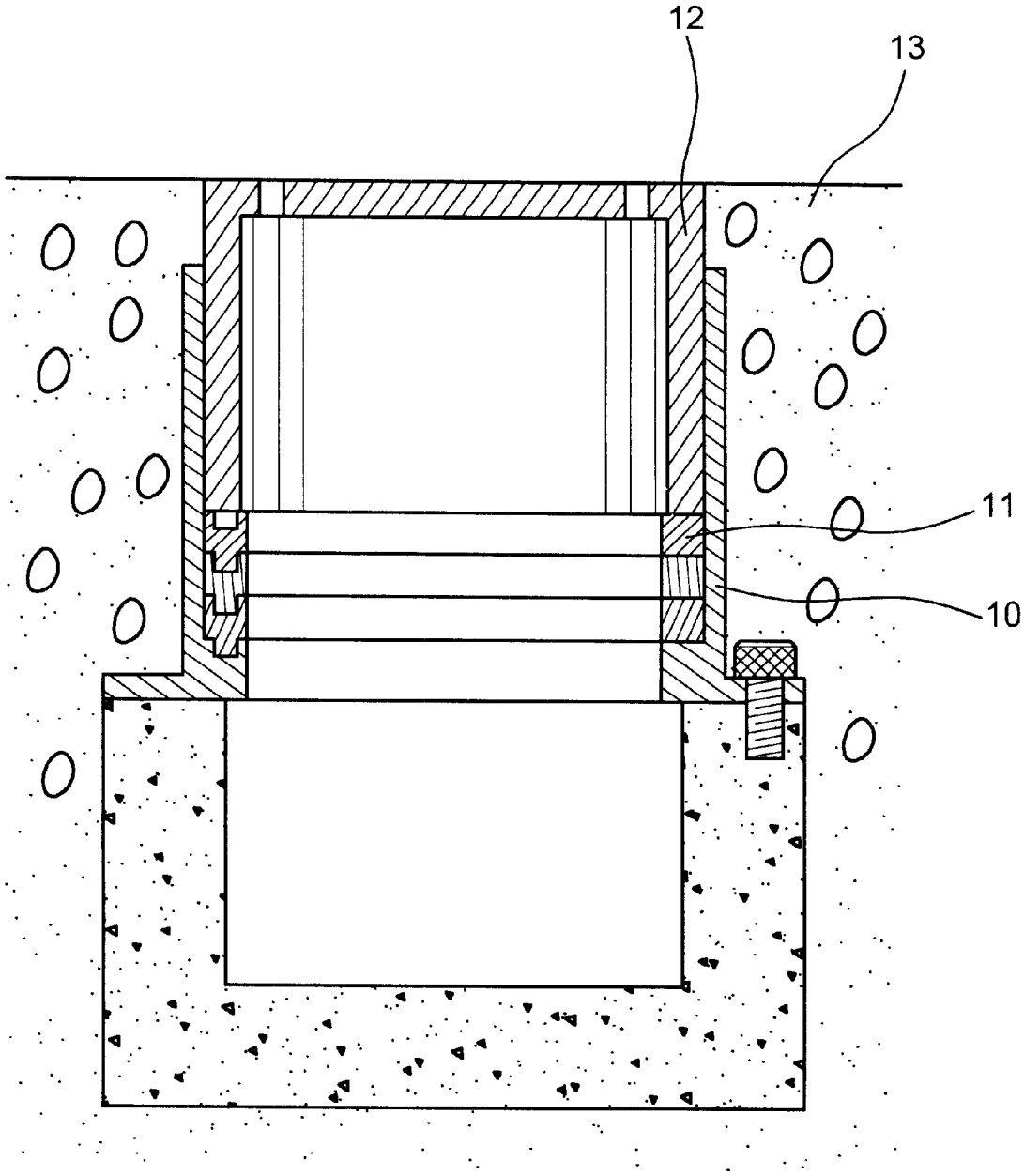
FIG.3 Prior Art
FIG. 3 is a sectional view to show a superimposed drain cover of another prior art.
Figure 4:
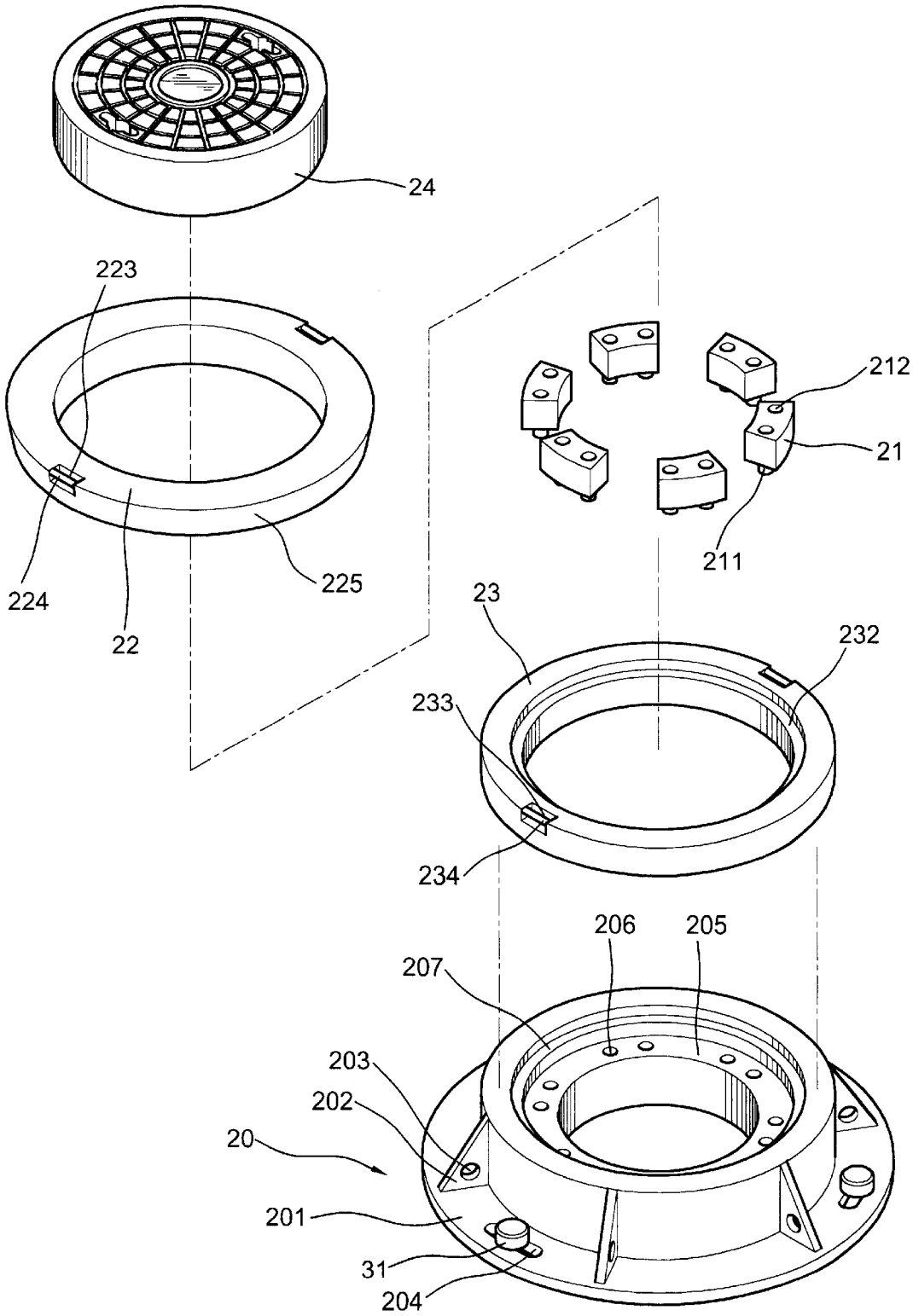
FIG. 4 is an exploded perspective view to show a superimposed drain cover according the preferred embodiment of the present invention.
Figure 5:
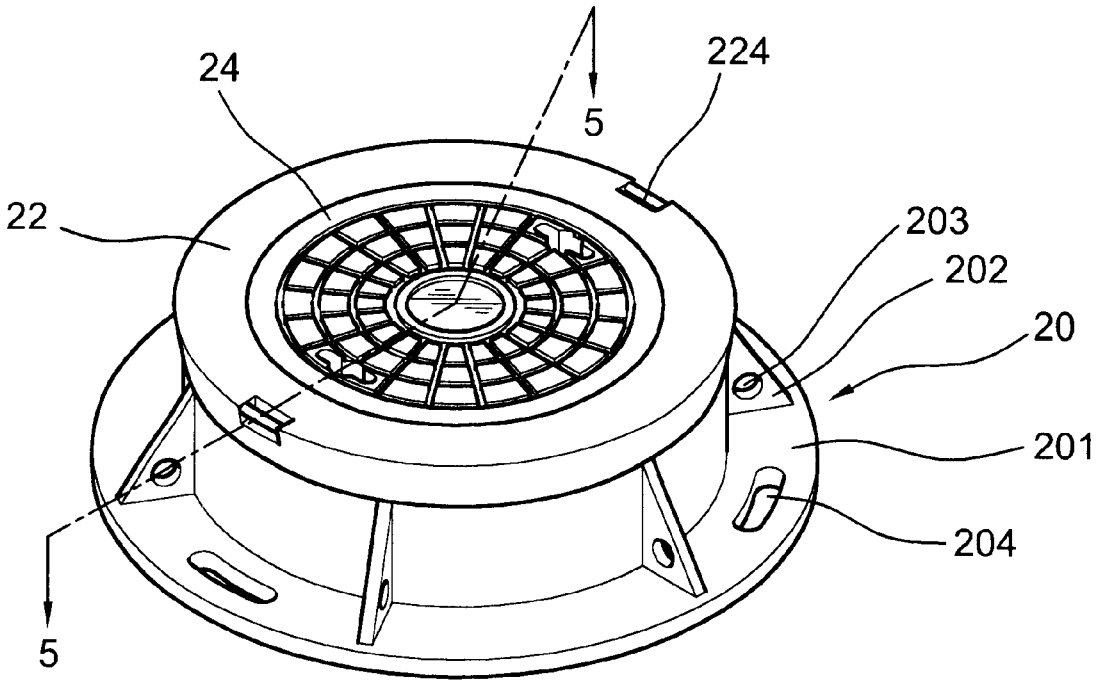
FIG. 5 is a perspective view of the assembly of FIG. 4.
Figure 6:
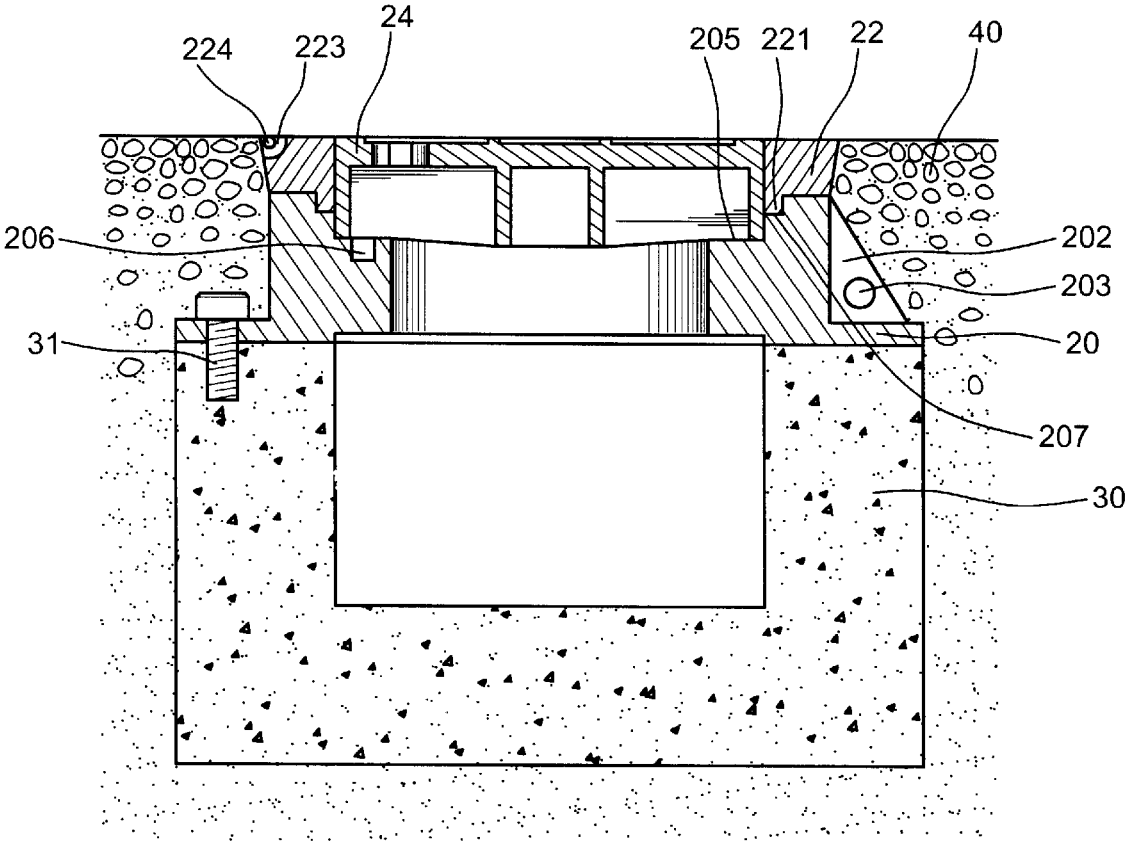
FIG. 6 is a sectional view taken along line 5—5 of FIG. 5 in which both the cushion pieces and the spare superimposed ring are unused.
Figure 7:
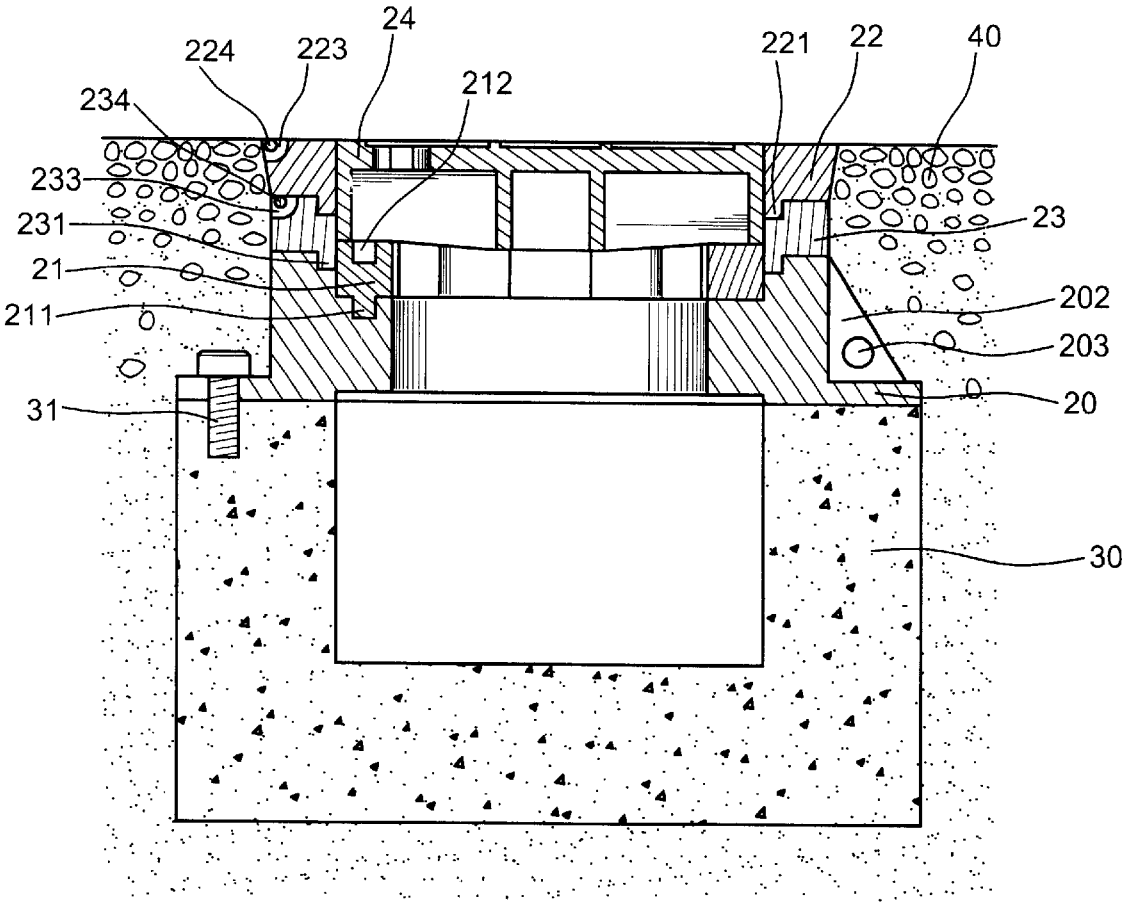
FIG. 7 is a sectional view of FIG. 5 in which both the cushion pieces and the spare superimposed ring are used.

With reference to FIGS. 4, 5 and 6 of the drawings, the superimposed drain cover of the present invention comprises a tubular seat 20 having a flange 201 projected outward from the bottom thereof, a plurality of triangular ribs 202 vertically connected spaced apart to the outer peripheral wall and the top of the flange 201 respectively each including suspending hole 203, a plurality of oblong holes 204 spacedly formed in the flange 201 for securing the seat 20 to a cement drain 30 by screws 31, a first and a second inner shoulders 205 and 207 formed inside the seat 20 and a plurality of positioning holes 206 spacedly formed in the top of the first inner shoulder 205 on pair by pair basis. A plurality of cushion pieces 21 are provided each having pair of positioning rods 211 spacedly projected downward from the bottom engageable with the positioning holes 206 of the seat 20 and a pair of positioning holes 212 spacedly formed in the top and positioned in alignment with the positioning rods 211 so that the cushion pieces 21 can be superimposed to each other. An outer ring 22 may be superimposed on the top of the seat 20 and has a downward flange 221 engageable with the second inner shoulder 207 of the seat 20, pair of notches 223 respectively formed in the opposing circumferences each including a suspending rod 224 therein and a tapered outer periphery 225 for which the outer ring 22 is readily lifted up without damaging the road surface. A spare superimposed ring 23 which may be more than one engaged between the tubular seat 20 and the outer ring 22 and has a downward flange 231 (as shown in FIG. 7) engageable with the second inner shoulder 207 of the seat 20, an inner shoulder 232 engageable with the downward flange 221 of the outer ring 22, a pair notches 233 respectively formed in the opposing circumferences thereof each including a suspending rod 234 therein. A cobweb surfaced circular cover 24 covers the top of the tubular seat 20 inside the outer ring 22 and stopped on the first inner shoulder 205 of the seat if there is no need for cushion pieces 21 (as shown in FIG. 6).

If the road surface 40 is repaired and higher than the cover 24, both the cushion pieces 21 and the spare superimposed ring 23 are used (as shown in FIG. 7) to keep the cover 24 even with the road surface 40.

When the road surface 40 becomes lower than the cover 24 after several years, both the cushion pieces 21 and the spare superimposed ring 23 are readily removed or that the road surface 40 becomes more higher than the cover 24, more cushion pieces 21 and spare superimposed rings 23 are available to be added. Therefore the cover 24 can be always kept even with the road surface to prevent any traffic accident or even the traffic noise.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A superimposed drain cover comprising:

a tubular seat having a flange extending outward from bottom thereof, a plurality of triangular ribs formed spaced apart and connected to outer peripheral wall and top of said flange respectively, said ribs each including a suspending hole therein, a plurality of oblong holes formed spaced apart in said flange for securing said tubular seat to a drain top by means of screws, a first and second inner shoulders steppedly formed inside said tubular seat facing upward wherein said first inner shoulder is positioned within said second inner shoulder and a plurality of first positioning holes spacedly formed around top surface of said first inner shoulder and positioned on pair by pair basis;

an outer ring engaged with top of said tubular seat having a first downward flange engaged with said second inner shoulder of said tubular seat, a pair of first notches respectively formed in opposing circumferences each including a first suspending rod therein and a tapered outer periphery thereof;

a cobweb surfaced cover covering top of said tubular seat within said outer ring and having a bottom engaged with said first inner shoulder of said tubular seat and an outer periphery engaged with an inner periphery of said outer ring;

a plurality of cushion pieces each having a pair of second positioning rods spacedly projected downward from bottom engageable with the first positioning holes of said tubular seat and a pair of second positioning holes spacedly formed in top and positioned in alignment with said second positioning rods; and a plurality of spare superimposed rings engageable between said tubular seat and outer ring and having a second downward flange engageable with said second inner shoulder, a third inner shoulder facing upward made in alignment with said second inner shoulder so as to be able to engaged with said first downward flange of said outer ring and a pair of second notches respectively formed in opposing circumferences thereof each including a second suspending rod therein.

* * * * *